US005454406A

United States Patent [19]

Rejret et al.

[11] Patent Number: 5,454,406

[45] Date of Patent: Oct. 3, 1995

[54] AUTOMATIC BEVERAGE DISPENSER

[75] Inventors: Richard L. Rejret; William C. Rantanen, both of Watertown; Michael G. Weimer, Oconomowoc; John W. Parmley, Watertown; Lawrence G. Searing, Nashotah; Larry D. Powers, Watertown, all of Wis.

[73] Assignee: Eaton Corporation, Cleveland, Ohio

[21] Appl. No.: 242,512

[22] Filed: May 13, 1994

[51] Int. Cl.[6] ..... B65B 1/30; B65B 3/26

[52] U.S. Cl. ..... 141/1; 141/83; 141/95; 141/114; 222/641; 137/624.12

[58] Field of Search ..... 141/1, 83, 94, 141/95, 198, 114; 222/639–641, 129.1, 504; 364/479; 137/624.11, 624.12

[56] References Cited

U.S. PATENT DOCUMENTS

| | | | |
|---|---|---|---|
| 2,726,841 | 12/1955 | Crist | 251/120 |
| 3,221,936 | 12/1965 | Spinuzza | 222/54 |
| 3,238,963 | 3/1966 | Witzel et al. | 137/170.1 |
| 3,666,143 | 5/1972 | Weston | 222/61 |
| 3,718,233 | 2/1973 | Nordhoff | 222/70 |
| 3,900,136 | 8/1975 | Paranto | 222/70 |
| 3,991,911 | 11/1976 | Shannon et al. | 222/25 |
| 4,031,913 | 6/1977 | Apellaniz | 137/170.1 |
| 4,111,243 | 9/1978 | Fetterman | 141/102 |
| 4,252,253 | 2/1981 | Shannon | 222/25 |
| 4,708,176 | 11/1987 | Esser | 141/65 |
| 4,748,998 | 6/1988 | Färber et al. | 137/170.1 |
| 4,890,774 | 1/1990 | Poore | 141/83 |
| 4,979,641 | 12/1990 | Turner | 222/25 |
| 5,007,560 | 4/1991 | Sassak | 222/1 |
| 5,022,557 | 6/1991 | Turner | 222/54 |
| 5,058,630 | 10/1991 | Wiley et al. | 222/129.1 |
| 5,062,555 | 11/1991 | Whigham et al. | 222/641 |
| 5,129,548 | 7/1992 | Wisniewski | 141/83 |

*Primary Examiner*—Henry J. Recla
*Assistant Examiner*—Steven O. Douglas

[57] ABSTRACT

A dispenser is programmed to automatically dispense a beverage into a plurality of different size containers by storing therein a volume designation for each size container. The flow rate of beverage through the dispenser is determined. To do so, a user manually operates the dispenser to fill a given container with the beverage while the dispenser measures the filling time. The dispenser calculates a beverage flow rate from the volume designation for the given container and the filling time. Then the flow rate and volume designations are used thereafter by the dispenser to derive a dispensing time for each different size container. Thus the dispenser is able to derive dispensing times for each container size from filling only one of the containers. A unique dispenser valve also is disclosed.

11 Claims, 5 Drawing Sheets

AUTOMATIC BEVERAGE DISPENSER

BACKGROUND OF THE INVENTION

The present invention relates to equipment for dispensing a beverage; and more particularly to apparatus for automatically filling a container of a specified size by controlling the amount of beverage which flows through a spout.

Restaurants and taverns frequently dispense beverages such as soft drinks and beer from a tap. Conventional taps have a lever operated valve in which a server manually operates the lever to fill a glass or pitcher with the beverage. Such manual operation requires that the server monitor the flow of beverage from the tap once the valve is opened so that the container is properly filled but does not overflow.

Some establishments have automatic beverage dispensers in which the server merely pushes a button and the proper amount of beverage is dispensed into the container from a spout. The beverages commonly are sold in a number of different size beverage containers and the dispenser has a corresponding number of buttons with a different button being pushed to dispense beverage into a particular size container. With such an automatic system, the server no longer has to monitor the dispensing operation, but can perform other tasks while the container is being filled. This is particularly advantageous when a relatively large volume container, such as a pitcher, is being filled.

In automatic systems, the amount of beverage which flows through the dispenser for a given size container is controlled by opening the valve for a particular time interval with different time intervals being used for the different size containers. Such a method assumes that the beverage will flow at a relatively uniform flow rate from one pour to the next. However, the flow rate at any given time can be affected by a number of variable factors, such as temperature, pressurization of the beverage source and the viscosity of the beverage.

In such an automatic dispenser, a mechanism must be provided for individually setting the duration of the pour for each size container. One such automatic dispensing device is shown in U.S. Pat. No. 3,900,136 in which separate timing devices are provided for each different sized container with a potentiometer used to set an interval for each timer. U.S. Pat. No. 4,979,643 discloses a computer controlled beverage dispenser in which different pour times for each container size are stored in a memory. These pour times are determined by manually dispensing beverage into each sized container while timing the interval that it takes to properly fill that container. In both of these automatic systems, the proper time interval for each size container must be determined by actually pouring beverage into that container while either adjusting a potentiometer or measuring the manual pour time for each container. Such a method is both time consuming and wasteful of beverage since the beverage during calibration may have to be discarded.

SUMMARY OF THE INVENTION

An object of the present invention is to eliminate the need to manually set timing intervals for each size of container to be filled automatically by a beverage dispensing system.

Another object of the present invention is to manually fill only one container and from information gathered during that operation, determine the filling times for all the sizes of containers to be filled automatically by the dispenser.

A further object of the present invention is to provide a mechanism which allows the container fill times to be adjusted during operation of the dispensing system to compensate for variations of the beverage flow rate over time.

Yet another object is to provide a solenoid operated dispensing valve for the tap of the dispensing system in which a flexible tube is pinched by an actuator to block the flow of the beverage through the dispenser.

These objects are fulfilled by a programming method which comprises storing into the beverage dispenser separate volume designations for each different size container to be filled automatically. The beverage dispenser is manually operated to fill a beverage container associated with a given volume designation. The dispenser measures an amount of time required to fill the container with an amount of beverage that corresponds to the given volume designation.

A control circuit in the beverage dispenser then calculates a beverage flow rate from the given volume designation and the amount of time. The flow rate and stored volume designations then are employed by the control circuit to derive a dispensing time for each different size of container. During automatic filling of containers, those dispensing times determine how long a time to dispense the beverage into each different size container. A mechanism also can be provided for the user to increment and decrement the dispensing times to compensate for variations in the beverage flow rate over time.

The present beverage dispenser also contains a novel valve that is operated by the control circuit to pour the beverage into the containers. That valve has a coupling for receiving the beverage from a supply and a resilient tube connects the coupling to a spout of the dispenser. An actuator, such as a solenoid, has an armature which is aligned with said resilient tube and a valve member is attached to the armature. The valve member is biased by a spring against said resilient tube thereby pushing the resilient tube against an anvil. This action pinches the resilient tube closed and prevents the beverage from flowing from the supply to the spout. When the solenoid is activated, the valve member is pulled away from the anvil, releasing the resilient tube so that the beverage can flow to the spout.

DETAILED DESCRIPTION OF THE INVENTION

Figure 1:
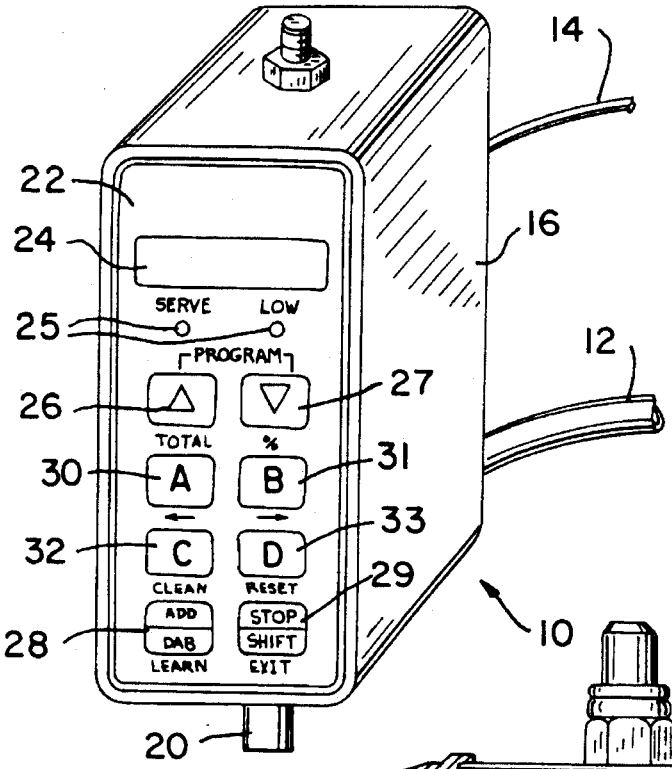
FIG. 1 is a schematic pictorial representation of an automatic beverage dispensing system according to the present invention.

The initial reference to FIG. 1, a beverage dispenser 10 is connected by a tube 12 to a source of beverage, such as a beer keg or a tank containing a soft drink, which is pressurized by a gas to force the beverage from the source through the tube. A cable 14 may extend from the dispenser 10 to a cash register or computer for automatically tabulating charges for beverages that are being dispensed.

The dispenser 10 has a housing 16 with a control panel 22 containing a display 24 that is used to present alphanumeric information to the beverage server. For example, the display 24 is employed to indicate the total quantity of beverage dispensed from a given keg or tank. A pair of light emitting devices 25 (such as LED's) indicate whether the system is serving the beverage and whether the quantity of beverage in the keg or tank is low.

The control panel 22 also has a number of membrane push button switches 26–33 which are operated by the beverage server. During dispensing operation, switches 30, 31, 32 and 33 select which one of four different size beverage containers is to be filled. For example, switches 30 and 31 may correspond to different sized glasses, switch 32 designates a mug and switch 33 corresponds to a pitcher. In operation, the server places a container beneath spout 20 which extends downward from the dispenser housing 16. Then the server pushes the corresponding switch 30–33 on the control panel 22 to initiate automatic dispensing of beverage from the spout into the container. Push button switch 28 is used to add a small quantity of beverage to increase the head on a container of beer. Switch 29 is used to terminate a pour that is in progress. As will be described, switches 26 and 27 are used to adjust the amount of beverage that is dispensed automatically.

When the dispenser is not filling a container, pressing switch 29 in conjunction with other switches causes various items of information to be displayed. For example, pressing switch 29 and then switch 26 presents on display 24 the total volume of beverage that has been dispensed since the source of the beverage was changed. This display of information has been used in previous dispensers and will not be described in detail.

Switches 26 and 27 also can be pressed simultaneously to place the dispensing system in a programming mode. In that mode, the buttons on the control panel 22 have different functions than in the dispensing mode. For example, button 28 then is used to place the system in a "learn" mode in which the flow rate of beverage through the dispenser 10 is derived. Buttons 30 and 31 are employed in the program mode to step the system through different programming functions and individually pressing buttons 26 and 27 increment or decrement various functional values which are presented to the user on display 24. Button 29 is used to exit the program mode. The operation of the program mode will be described subsequently with respect to programming the beverage dispenser 10 for the different sizes of containers to be filled and determine the proper time interval required to fill those containers.

Figure 2:
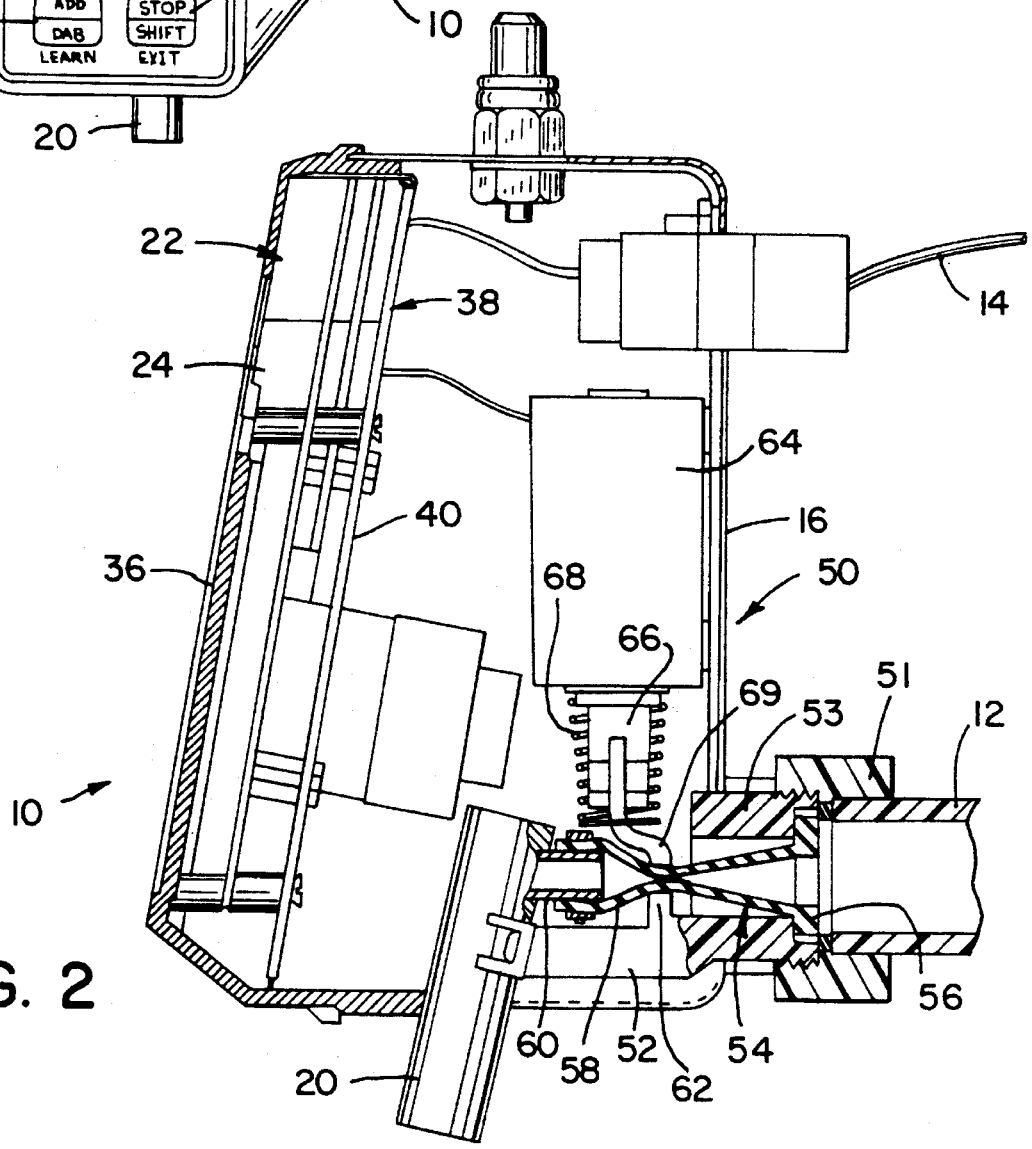
FIG. 2 is a cross-section through the beverage dispenser station in FIG. 1.

FIG. 2 shows the interior of the beverage dispenser 10. The push button switches 26–33 are part of a membrane key pad 36 connected to a printed circuit board 38 located within the dispenser housing 16. The key pad 36 and display 24 are electrically connected to the printed circuit board 38 which contains a control circuit 40 for operating the dispenser 10.

Figure 3:
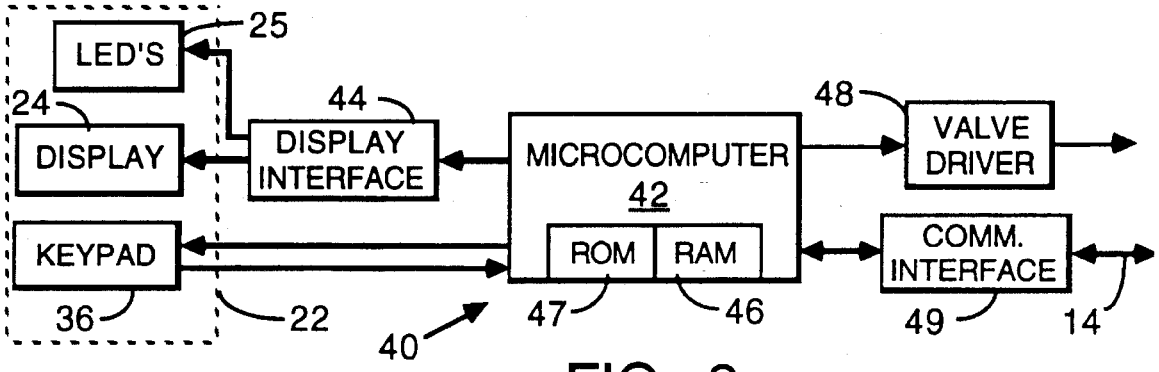
FIG. 3 is a block schematic drawing of a computerized control circuit for the beverage dispenser.

The control circuit 40 is shown in detail in FIG. 3 and has a microcomputer 42 that includes a microprocessor, input/output ports, memory and timer circuits. The key pad 36 is connected to an input/output port so that the microcomputer can strobe output lines coupled to each column of switches on the keypad 36 and receive signals on input lines coupled to each row of the switches. This common technique enables the microcomputer to detect when the server has activated a given switch 26–33 on keypad 36. A display interface 44 couples the microcomputer to the display 24 and the LED's 25. A program for operating the dispenser 10 is stored in a read only memory (ROM) 47 and an random access memory (RAM) 46 is provided in the microcomputer 42 to store variables used during operation of the beverage dispenser.

In response to execution of the control program, the microcomputer 42 sends a signal to a valve driver 48 to open or close a valve of the dispenser 10. A communication interface 49 couples the microcomputer to a cash register or to a central computer for the restaurant or tavern. The exact type of control circuit 40 is not critical to practicing the present invention and other types of circuits may be employed.

Referring again to FIG. 2, the control circuit 40 operates a solenoid valve 50 in the dispenser housing 16. The tube 12 from the beverage source is connected by a coupling 51 to a threaded tubular portion 53 of valve bracket 52. A valve tube 54 fabricated of rubber has a outward extending flange 56 at one end which is held in a depression in the valve bracket 52. The valve tube 54 has a resilient tubular section 58 that extends through the tubular portion 53 of the valve bracket 52 and is coupled to an inlet fitting 60 on spout 20. For example, the valve tube 54 is slid over the inlet fitting 60 and held in place by a cable tie or a hose clamp. The upper surface of the valve bracket 52 has a rectangular, flat anvil 62 that projects upward abutting the tubular section 58 of the valve tube 54.

Directly above valve tube 54 is a solenoid 64 which is electrically operated in response to a control signal from the valve driver 48 of the control circuit in FIG. 3. The solenoid has an armature 66 with an external end to which a pinch-off bracket 69 is fixedly attached. When the solenoid 64 is deenergized, a compression spring 68 of the solenoid pushes the armature 66 downward forcing the pinch-off bracket 69 against the valve tube 54. This action causes the pinch-off bracket to pinch the valve tube against the anvil 62 of the valve bracket 52 and closes the interior passage through the valve tube preventing the flow of pressurized beverage from the supply tube 12 to the spout 20. When the solenoid 64 is energized in response to a signal from microcomputer 42, the solenoid armature 66 and pinch-off bracket 69 move upward releasing the resilient valve tube 54 allowing the beverage to flow therethrough. One skilled in the art will appreciate that the solenoid can be replaced by other types of actuators which can be operated in response to a signal from control circuit 40.

The valve actuator and its axis of movement lie in the same plane as the longitudinal axis of the valve tube. Because the pinch-off bracket 69 and solenoid 64 are directly above the valve tube 54, a direct pinching action occurs. The present solenoid mechanism requires a shorter actuator travel and less spring force as compared to previous valves which used a pinch-off lever. Those other valves also required careful adjustment of the lever mechanism in order to assure full closure.

The beverage dispenser 10 automatically operates the solenoid valve 50 to dispense the proper volume of beverage depending upon the size of the particular container that the server places beneath spout 20. The operation of the dispenser is controlled by a software program executed by the microcomputer 42 of the control circuit 40. This program has timed interrupts which cause certain routines to be executed, such as a conventional timer routine and others to be described subsequently. The main part of the program tests for actuation of the key pad 36 and branches to appropriate routines that respond to the specific switch or combination of switches pressed. For example, pressing one of switches 30–33 causes a predefined amount of beverage to be dispensed automatically.

Before the beverage dispenser 10 can be operated in this automatic mode, it must be programmed with the different sizes of containers that are to be used and taught the flow rate of the beverage through tube 12 in order to calculate the time interval that it takes to fill each different sized container. To do this, the user places the beverage dispenser 10 in the program mode by simultaneously pressing the up and down arrow push button switches 26 and 27, shown in FIG. 1. The simultaneous depression of these switches is detected by the microcomputer 42 which responds by branching to a section of the control program stored in ROM 47 which performs the programming function. This programming function stores values for different variables used later in the dispensing mode of operation. For example, these variables include designation of the volume for each container associated with push button switches 30–33 which are labelled A, B, C, and D on the control panel 22. Once the programming mode has been entered, the user presses the switches 26 and 27 labelled with vertical arrows to step through different programming operations, the names of which are sequentially displayed to the user on display 24. To select a specific displayed programming operation, the user presses switch 31 which also is labelled with a right pointing arrow for this mode.

Figure 4:
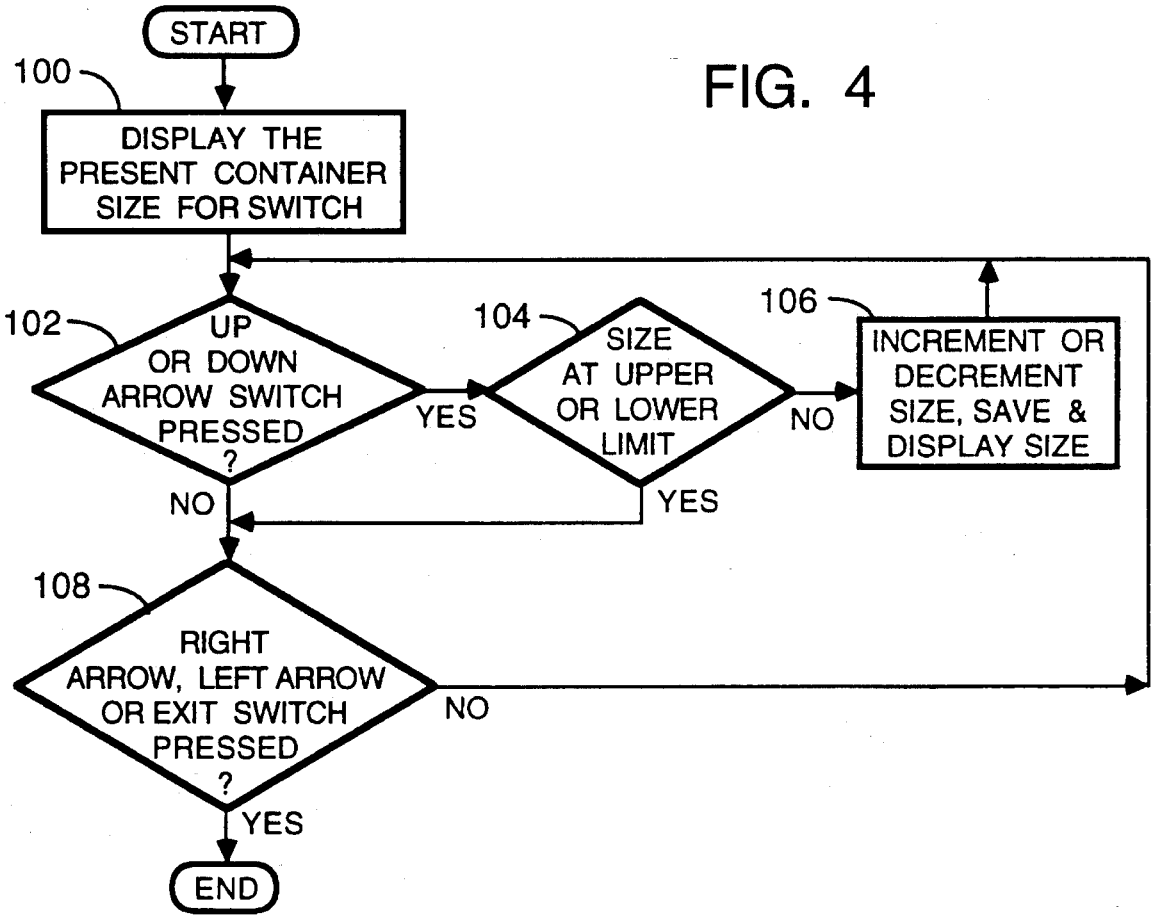
FIG. 4 is a flowchart of a software routine executed by the computerized control circuit to designate volumes for different size containers to be filled.

One of these programming operations allows the user to designate a dispensing volume for each of the lettered push button switches 30–33. The user selects the particular push button switch and the microcomputer 42 begins executing a routine of the programming mode which is depicted in the flowchart of FIG. 4. This routine commences at step 100 where the present designation of the volume for the selected switch 30–33 is obtained from a location in RAM 46 and is presented on display 24. Then the microcomputer 42 enters a program loop in which the user is able to alter the volume designation. Specifically at step 102, the push button switches 26 and 27 labelled with up and down arrows are checked. When either switch is pressed, a branch to step 104 occurs where a check is made whether the user is attempting to change the volume designation beyond upper and lower limits. If that is not the case, the routine advances to step 106, where the volume designation is incremented or decremented by "one" depending upon which push button switch 26 or 27, respectively, was activated by the user. The new volume designation then is stored into RAM 46 and displayed on device 24 before the execution returns to step 102.

If at step 102 neither switch 26 or 27 was not found to be pressed, step 108 is executed to test whether the user is seeking to exit this programming mode by pressing the left or right arrow switches 30 or 31, or the exit switch 29. If that is the case the volume designation setting routine ends, otherwise the execution returns to step 102. The routine ends by returning to the main part of the programming mode software. In this manner, variables designating the volume of each different size container to be filled by pressing each one of the switches 30–33 is stored as a table within a section of the RAM 46.

Figure 5:
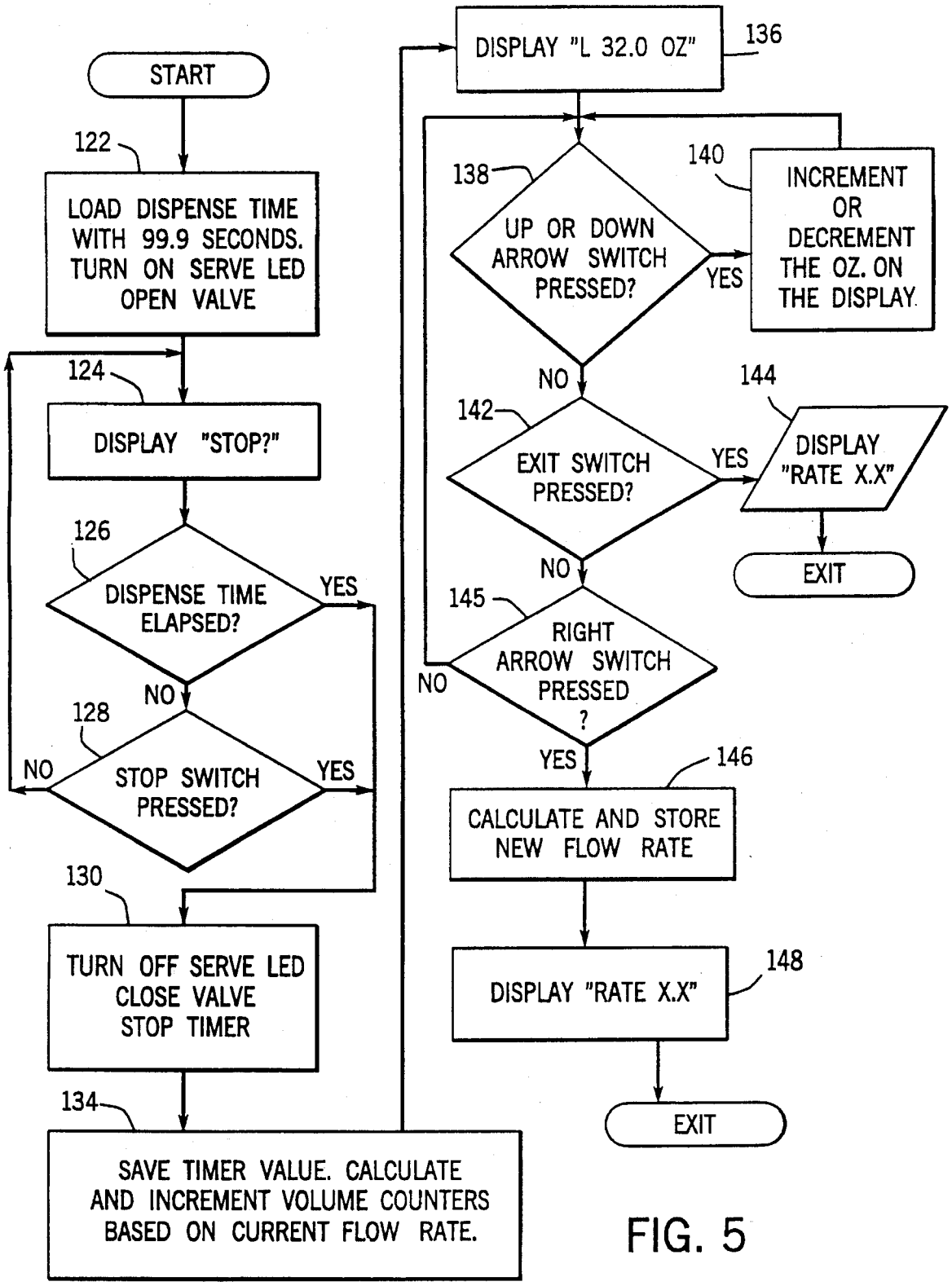
FIG. 5 is a flowchart of a software routine by which the beverage dispenser learns the flow rate of the beverage.

Another programming operation designated the "learn" operation enables the beverage dispenser 10 to measure the flow rate of the beverage through the supply tube 12. As will be described, this flow rate then is used to determine how long a time to automatically dispense beverage for each different sized container associated with push button switches 30–33. After the user enters the learn operation depicted in FIG. 5, a timer within the microcomputer 42 is loaded with the maximum value of 99.9 seconds at step 122 and a signal is sent via the valve driver 48 to the solenoid 64 which opens the valve tube 54 causing the beverage to be dispensed. Prior to entering the learn operation, the user placed a container of a known volume beneath spout 20. Preferably, a graduated container of at least 32 ounces is used. When the valve opens, the beverage begins to pour from the spout 20 into that container.

Next at step 124, the microcomputer presents the message "STOP?" to the user on display 24. This message indicates that the user is required to monitor the filling of the container and press the stop push button switch 29 when the container has been filled to the known volume level. The pouring of beverage from spout 20 continues until either the timer has elapsed or the stop switch 29 has been pressed. These events are detected at steps 126 and 128 and the occurrence of either event causes the program execution to advance to step 130 where the serve LED 25 is turned off and the solenoid valve 50 closed, thereby terminating the flow of beverage. The termination of the beverage dispensing also stops the timer which holds a value corresponding to the interval that it took to dispense the known volume of beverage. The execution advances to step 134 where the present value of the timer is subtracted from 99.9 (the timer starting value) to calculate the length of the dispensing time. The dispensing time is saved in a temporary location within RAM 46. The microcomputer 42 also keeps track of the total volume dispensed from a given beverage keg or tank and that volume is incremented by an amount calculated from the timer value and a previously programmed beverage flow rate.

Next the program execution by the microcomputer 42 advances to step 136 where the microcomputer is informed of the volume which was dispensed into the graduated container. At this point, the microcomputer sets the dispensed volume to a default value of 32.0 ounces, which amount is displayed on device 24. Then the user is afforded the opportunity to increment or decrement that default amount if a different sized container was used during the learn operation. Specifically at step 138, the up and down arrow switches 26 and 27 are tested and if pressed, the program execution branches to step 140 where the display value is appropriately incremented or decremented. If neither arrow switch is pressed, the program execution advances to step 142 where the exit switch 29 is tested. This switch is pressed by the user to abort the learn operation in which case the display is activated at step 144 to display the old flow rate before exiting. When the exit switch 29 is not found to be pressed at step 142, step 145 is executed where the push button switch 31 labelled with the right arrow is tested. If this push button switch is not pressed, the program returns to step 138 and continues to loop allowing the user to further increment or decrement the volume indication for the container.

When the user is satisfied with the displayed volume indication, the right arrow push button 31 is pressed and the program execution advances to step 146. At this time, the microcomputer 42 calculates a new flow rate by dividing the volume of the container used during the learn operation with the dispensing time measured in the learn operation. The new flow rate is stored in a memory location within RAM 46 and then displayed to the user at step 148 before the learn operation exits returning to the main portion of the programming mode software.

The learn operation enables the microcomputer 42 to determine the flow rate of the beverage from the particular supply tube 12. That operation can be executed periodically to recalibrate the dispenser 10 for the actual flow rate.

During the dispensing mode of operation, each time a server presses one of the push button switches 30–33 corresponding to a particular sized beverage container, the flow rate and the volume designated for that container are used to calculate the amount of time that the microcomputer 42 should energize the solenoid valve 50 to pour beverage into the container.

Figure 6:
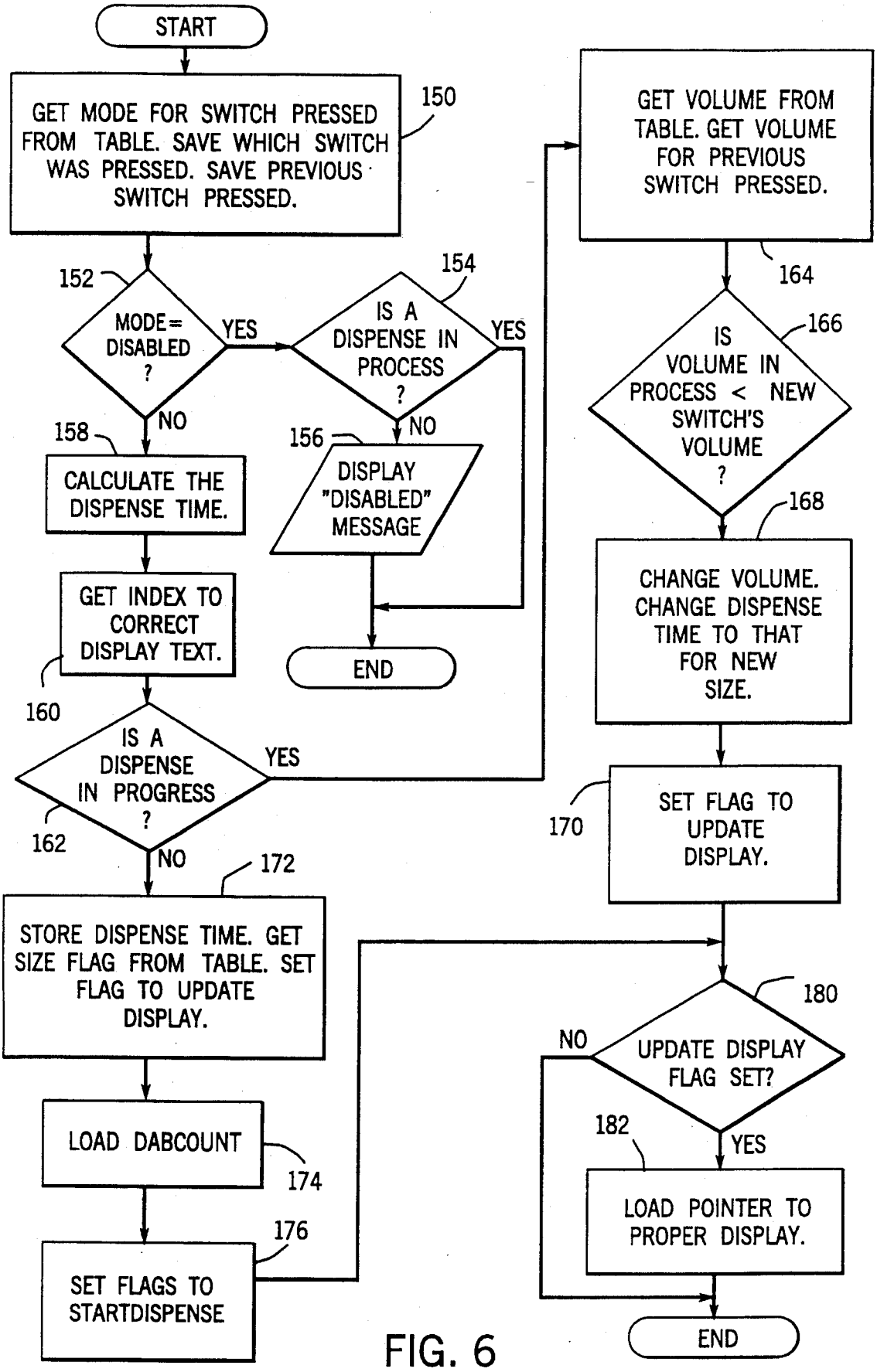
FIG. 6 is a flowchart of a software routine which controls dispensing of the beverage.

When one of the push button switches 30–33 is pressed by the user, the microcomputer 42 enters the portion of its control program depicted in FIG. 6. Initially at step 150, a MODE variable for the pressed switch is obtained from a table within RAM 46 which indicates whether the particular push button switch has been enabled for dispensing purposes. For example, the control panel 22 has four separate push button switches 30–33 for dispensing beverages into a similar number of different sized containers. A given restaurant or tavern may have a lesser number of different sized containers, in which case, not all of the push button switches 30–33 would be enabled. Also at step 150, a flag is set indicating which push button switch was pressed at this time and another flag is set to indicate the previously pressed switch. Next at step 152, the MODE variable is inspected to detect if the particular switch is disabled, in which case the program execution branches to step 154 where a determination is made whether a dispensing operation is in process. If not, the word "DISABLED" is displayed on device 24 at step 156 for one second before this routine terminates.

If the MODE variable for the pressed switch indicates that it is enabled, the program execution branches from step 152 to step 158. At this point, the microcomputer 42 calculates the dispense time according to the equation:

DISPENSE TIME=(DESIGNATED VOLUME * TRIM FACTOR)/FLOW RATE

The TRIM FACTOR has a value between 0.90 and 1.10 which is set to 1.00 during the programming mode and thereafter may be changed by the user in a manner that will be described subsequently. A separate TRIM FACTOR is stored in a table in RAM 46 for each push button switch 30–31. Once the dispense time has been calculated, the indication of the particular push button switch 30–33 which was pressed is used to index into a table of display data contained in ROM 47 and a display pointer is set to that text location. Then another determination is made whether the beverage is presently being dispensed, thus providing an indication whether the server has pressed one of the push button switches 30–33 while the beverage is pouring from spout 20.

If the beverage is already being dispensed, the program branches to step 164 where the volume designation for the most recently pressed switch 30–33 and the volume designation for the previously pressed switch are obtained from RAM 46. The volume designation for the previously pressed switch indicates the volume that is being used for the dispensing operation that is in process. Then at step 166, a determination is made whether the volume for the current dispensing process is less than the volume for the newly pressed switch. If that is the case, the server is indicating that the volume being used for dispensing should be increased as apparently a larger container is being used than that which corresponded to the originally pressed push button switch 30–33. Therefore, the program advances to step 168 where the variable used to indicate the volume of the container into which beverage is currently being dispensed is changed to the appropriate value. In addition, the dispense time is changed to that which was just computed for the newly pressed push button switch. In changing the dispense time, the current value of the dispensing timer is subtracted from the new dispense time and the difference is reloaded into the timer. This ensures that the new dispensing time will be adjusted to account for the volume of beverage which already has been poured into the container. Then at step 170, a flag is set to update the display to indicate that a different sized container has been selected before advancing to step 180.

However, if at step 162 a determination was made that a dispensing operation was not in process, the program execution branches to step 172 where the dispense time calculated at step 158 was placed into a temporary storage location in RAM 46. The particular push button switch 30–33 which was pressed then is used to index a table within RAM 46 which contains the designated volume for the associated container. Next a flag is set so that the display 24 will be updated with information about the selected container. Then at step 174, a corresponding value from the table within RAM 46 that indicates the number of dabs that can be added to the selected sized container is loaded into a counter storage location within RAM 46. A dab is a fixed small amount of the beverage which is dispensed each time switch 28 is pressed in the dispensing mode. Flags are set at step 176 to indicate that a dispensing operation should commence. The control of solenoid valve 50 is performed by an interrupt routine that is executed periodically (e.g. every 2.5 milliseconds) by the microcomputer 42 based on a timed interrupt. The setting of this flag causes the valve to be opened when that interrupt routine is again executed. When the dispense interrupt routine is executed, the dispense time which was stored into RAM 46 at step 172 is obtained and loaded into the dispense timer. This action causes the microcomputer 42 to send a control signal to the valve driver 48 which in turn energizes the solenoid valve 50 into an open state. This interrupt routine also checks the value of the timer and when it has elapsed, the control signal is terminated to deenergize and close the solenoid valve 50. Then the program advances to step 180.

At step 180, the update display flag is set so that another timed interrupt routine which controls the display of information will be executed to update the display 24. Then at step 182, the pointer is loaded to the proper display text.

As noted above, the dispense time calculated for a given container is a function not only of the designated volume for that container and the flow rate of the beverage through tube 12, but also is a function of a variable designated the TRIM FACTOR. The TRIM FACTOR is adjustable by the user at the termination of pouring beverage into the container. This allows the dispensing operation to be compensated for variations of the actual flow rate of the beverage which are due to a number of factors, such as fluctuations in temperature, pressurization of the beverage supply and viscosity of the beverage. Therefore, following the termination of the dispense routine shown in FIG. 6, the microprocessor tests the keypad 36 to determine whether the user is depressing any switch. If this detects that the server is depressing either the up or down arrow switch 26 or 27, the program execution jumps to step 190 or 191, respectively, on FIG. 7 where a pointer is set to the appropriate display text for indicating a trim down or a trim up. The trimming operation then advances to step 192 where a test is made whether dispensing currently is in process. If so, the program execution jumps to step 194 where the trim mode is aborted and the display is returned to a default message.

If however a dispense operation is not in process, a determination is made at step 196 whether more than 30 seconds have elapsed since the termination of the last dispensing operation. If that is the case, adjustment of the TRIM FACTOR is not allowed and the trim operation also aborts. Another test is made at step 198 as to whether the trim function has been enabled for this beverage dispenser 10. In some installations, the operator of the restaurant or tavern may not wish the trim to be adjustable. In that case the trim mode has been disabled and an appropriate message is then displayed for one second at step 200 before the trim operation is aborted.

Figure 7:
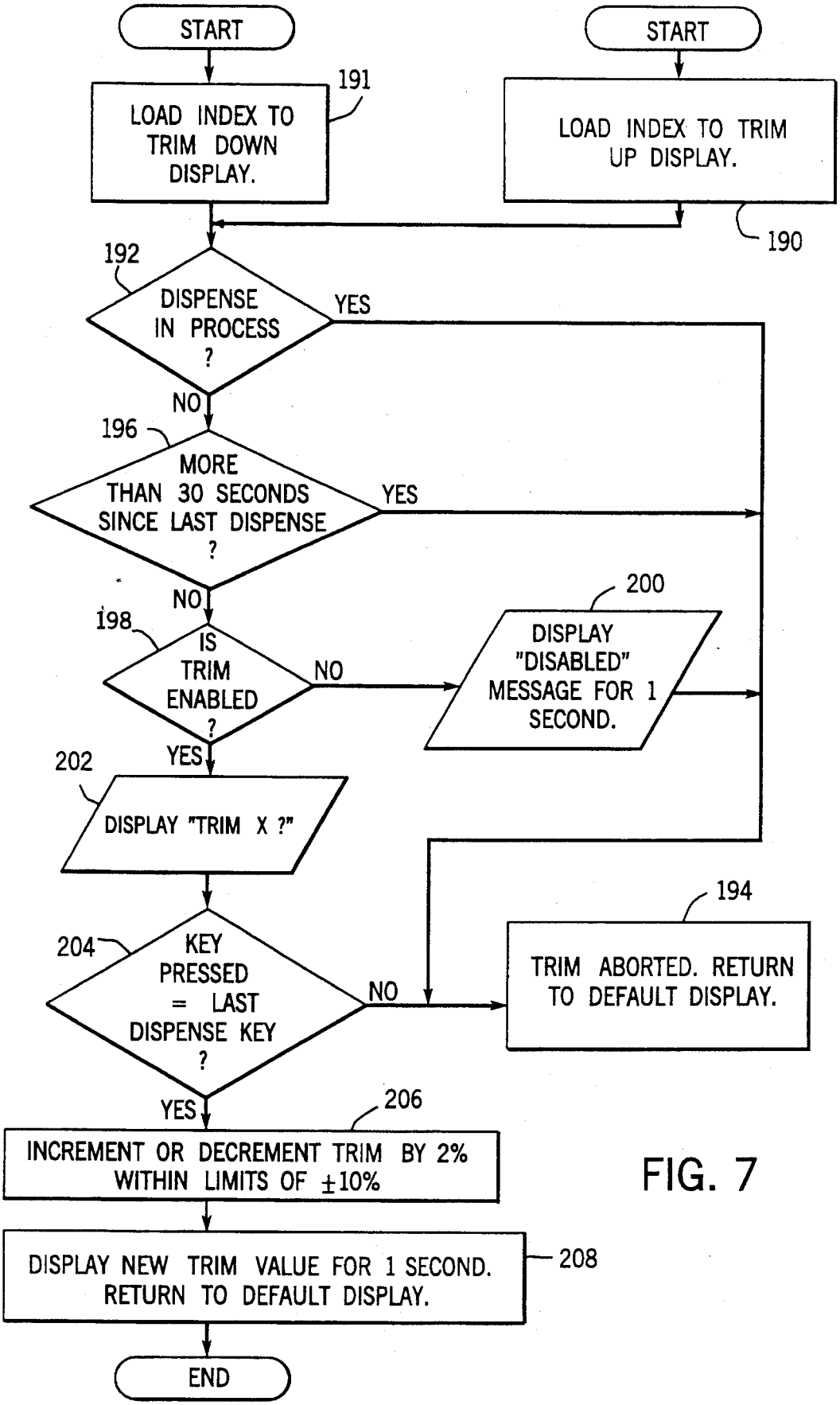
FIG. 7 is a flowchart of a software routine by which a user is able to adjust the amount of beverage poured by the dispenser.

Assuming that a trim operation is appropriate at this time, the program execution reaches step 202 where the display 24 is set to present the message "TRIM X?" where the X is replaced with the appropriate up or down arrow symbol depending upon the push button switch 26 or 27 which was just pressed. As a safeguard against inadvertently changing the TRIM FACTOR, the user must again press the switch 30, 31, 32 or 33 that was used immediately prior to dispense the beverage. If that switch is not pressed at step 204 the trim routine aborts. Otherwise the program advances to step 206, where the TRIM FACTOR is incremented or decremented, depending upon the arrow switch that was pressed, by two percent within ±10 percent of its nominal value. Specifically, the TRIM FACTOR is initially set to 1.00 during the learn operation in the programming mode. Each time that the trim routine in FIG. 7 is executed, the previous value of the TRIM FACTOR is incremented or decremented by 0.02. For example, if the TRIM FACTOR is to be increased by four percent, the new value of the TRIM FACTOR will be 1.04. Either the TRIM FACTOR can be stored directly in the RAM 46 or a trim value corresponding to the percentage of adjustment (positive or negative) can be stored and used to index a table to obtain the correct multiplier value whenever the dispensed time is calculated by the microcomputer 42 at step 158. A TRIM FACTOR, however, can only be adjusted by ±10 percent, i.e. within the range 0.90 to 1.10. Any attempt to adjust the TRIM FACTOR beyond these limits will result in the corresponding limit being used. Once the new trim value or TRIM FACTOR has been determined and stored at step 206, the program execution advances to step 208 where the newly computed value is displayed on device 24 for one second before the display returns to a default message. Then the trim program terminates returning back to the main portion of the dispensing mode program.

We claim:

1. A method of programing a beverage dispenser which includes a computer to automatically dispense a beverage into a plurality of containers of different sizes, steps of the method comprising:

storing into the computer a volume designation for each container of a different size;

using the beverage dispenser to fill a beverage container corresponding to a given volume designation stored in the computer;

the computer measuring an amount of time required to fill the beverage container of a known size;

the computer calculating a beverage flow rate from the given volume designation and the amount of time;

the computer deriving, from the flow rate and the stored volume designations, a dispensing time for each container of a different size; and the computer thereafter using the dispensing time to control how long to dispense the beverage into a container.

2. The method as recited in claim 1 wherein the beverage dispenser has a input device that is operable by a user of the beverage dispenser to indicate whether too much beverage is being dispensed automatically into a container of a defined size; and said computer is responsive to activation of the input device by decreasing the dispensing time for the container of the defined size.

3. The method as recited in claim 1 wherein the beverage dispenser has a input device that is operable by a user of the beverage dispenser to indicate whether not enough beverage is being dispensed automatically into a container of a defined size; and said computer is responsive to activation of the input device by increasing the dispensing time for the container of the defined size.

4. The method as recited in claim 1 wherein the step of using the beverage dispenser to fill a beverage container comprises:

placing the computer into a programming mode;

the user entering a first command into the computer to initiate dispensing the beverage into the container of the defined size; and the user entering a second command into the computer to terminate dispensing the beverage.

5. The method as recited in claim 4 wherein the step of measuring an amount of time comprises measuring a time interval between the first and second commands.

6. A method of operating a beverage dispenser to automatically dispense a beverage into containers of different sizes, steps of the method comprising:

(a) placing the beverage dispenser in a programming mode and then:

storing, in the beverage dispenser, a separate volume designation for each container of a different size;

manually activating the beverage dispenser to pour the beverage into a given container;

the beverage dispenser being responsive to the activating by starting a timer;

manually terminating the beverage dispenser pouring the beverage when an amount of beverage dispensed corresponds to a given volume designation;

the beverage dispenser responding to the terminating by stopping the timer;

the beverage dispenser calculating a beverage flow rate from the given volume designation and an amount of time indicated by the timer; and (b) placing the beverage dispenser into a dispensing mode in which the beverage dispenser responds to a user's command which designates a container of a given size is to be filled with beverage by performing the steps of:

deriving a dispensing time from stored volume designation for the container of the given size and the flow rate; and dispensing the beverage for the dispensing time.

7. The method recited in claim 6 wherein the dispensing time is derived using a TRIM FACTOR which compensates for variation in an actual flow rate of the beverage; and wherein after dispensing the beverage the method further includes responding to a user command by altering the TRIM FACTOR.

8. A beverage dispenser for automatically dispensing a beverage into containers of different sizes, said beverage dispenser comprising:

a tap having a valve that operates in response to a control signal;

an input device operable by a user of said beverage dispenser to enter commands;

a control circuit connected to said input device and said tap, and producing the control signal that is applied to operate the valve, wherein said control circuit includes:

(a) a first memory section that stores a volume designation for each container of a different size, the volume designation being received from said input device upon activation by the user;

(b) a mechanism connected to the input device and the valve to produce the control signal in response to a first command from said input device to begin dispensing the beverage, and thereafter to terminate producing the control signal in response to a second command from said input device;

(c) a timer coupled to said mechanism to measure a time interval between receiving the first and second command from said input device;

(d) a flow rate calculator coupled to said first memory section and said timer, and determining a beverage flow rate from a stored volume designation and time interval;

(e) a second memory section coupled to said flow rate calculator and storing the beverage flow rate; and (f) a dispensing time calculator coupled to said first and second memory sections and deriving, from the flow rate and stored volume designations, a dispensing time for each container of a different size.

9. The beverage dispenser as recited in claim 8 wherein said control circuit further includes another mechanism which changes the dispensing time for a given size of container in response to a third command from said input device.

10. A beverage dispenser for automatically dispensing a beverage into containers of different sizes, said beverage dispenser comprising:

a coupling for receiving the beverage from a supply;

a spout having an inlet;

a resilient tube connecting said coupling to the inlet of said spout;

an actuator having an armature which is aligned with said resilient tube;

a valve member coupled to the armature, wherein said actuator in a deenergized state forces said valve member against said resilient tube to prevent the beverage from being dispensed, and said actuator in an energized state drives said valve member away from said resilient tube to allow the beverage to flow through the resilient tube;

a input device operable by a user of the beverage dispenser; and a control circuit, responsive to a signal from said input device by energizing said actuator for a given period of time to allow the beverage to flow through said resilient tube, wherein said control circuit comprises (a) a first memory section that stores a volume designation for each container of a different size which is to be filled with the beverage, each volume designation being received from said input device upon activation by the user;

(b) a mechanism connected to the input device and the valve, and producing the control signal in response to a first command from said input device to begin dispensing the beverage, and thereafter terminating the control signal in response to a second command from said input device;

(c) a timer coupled to said mechanism to measure a time interval between receiving the first and second command from said input device;

(d) a flow rate calculator coupled to said first memory section and said timer and determining a beverage flow rate from a stored volume designation and time interval;

(e) a second memory section coupled to said flow rate calculator and storing the beverage flow rate; and (f) a dispensing time calculator coupled to said first and second memories and deriving, from the flow rate and stored volume designations, a dispensing time for each container of a different size.

11. The beverage dispenser recited in claim 10 wherein said tap includes an anvil on one side of said resilient tube and said actuator in the deenergized state pinches said resilient tube between said valve member and said anvil.

* * * * *